US009016833B2

(12) United States Patent
Ito et al.

(10) Patent No.: US 9,016,833 B2
(45) Date of Patent: Apr. 28, 2015

(54) PRINTING APPARATUS

(71) Applicant: Seiko Epson Corporation, Tokyo (JP)

(72) Inventors: Sukehiro Ito, Nagano-ken (JP); Kiyotaka Ogura, Nagano-ken (JP); Hideyuki Kataoka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/134,235

(22) Filed: Dec. 19, 2013

(65) Prior Publication Data

US 2014/0192114 A1 Jul. 10, 2014

(30) Foreign Application Priority Data

Jan. 10, 2013 (JP) ..... 2013-002363

(51) Int. Cl.
*B41J 23/00* (2006.01)
*B41J 19/00* (2006.01)

(52) U.S. Cl.
CPC ..... *B41J 19/005* (2013.01)

(58) Field of Classification Search
CPC ..... B41J 19/005; B41J 2002/14362; B41J 2202/14; B41J 2002/14491; B41J 2/175; B41J 2/145
USPC ..... 347/37, 85, 104
See application file for complete search history.

(56) References Cited

U.S. PATENT DOCUMENTS

2008/0174628 A1* 7/2008 Kubo et al. ..... 347/18

FOREIGN PATENT DOCUMENTS

JP 06-320835 11/1994
JP 2007-118436 5/2007

* cited by examiner

*Primary Examiner* — Jannelle M Lebron

(57) ABSTRACT

A printing apparatus which prints onto a recording medium by causing a print head to move in a main scanning direction includes a flexible cable through which, together with an arc-shaped loop, a signal is transmitted from a control substrate to the print head, a supporting member which is provided at a position which supports a portion of the flexible cable from the print head to the loop, and an insulating film which is provided between the supporting member and the flexible cable.

4 Claims, 6 Drawing Sheets

PRINTING APPARATUS

BACKGROUND

1. Technical Field

The present invention relates to a printing apparatus.

2. Related Art

As an ink jet printer which prints an image or a document onto a recording medium by discharging droplets such as ink, an ink jet printer which uses a piezoelectric element is known. The piezoelectric elements are provided corresponding to each of a plurality of nozzles in a print head and cause a predetermined amount of droplets to be discharged from the nozzles at a predetermined timing. The discharging is caused by driving each of the piezoelectric elements according to a drive signal together with movement along a main scanning direction of the print head and transportation of the recording medium in the sub-scanning direction. In order to appropriately drive the piezoelectric elements which are provided in the print head that reciprocates along the main scanning direction, a configuration is generally adopted in which a drive signal is supplied from a control substrate, which is provided in a housing of the printing apparatus, to the print head via a flexible cable (refer to JP-A-2007-118436). Specifically, a configuration is generally adopted in which the longitudinal direction of a conductor arrangement surface in the flexible cable, that is, the direction in which the conductor extends is matched with a movement direction of the print head, and the flexible cable is disposed such that the conductor arrangement surface and the planar recording medium face one another. According to this configuration, it is possible to realize a printer in which the height of the housing is suppressed.

However, when a configuration is adopted in which, as disclosed in JP-A-2007-118436, the flexible cable is disposed in a printer which performs printing on a large recording medium such as A3 or A2, the operational region of the print head becomes longer in proportion with the size of the recording medium and it is necessary to lengthen the flexible cable to accommodate the lengthening of the operational region. Therefore, the flexible cable flexes and deforms according to the movement of the print head and the weight of the flexible cable, and there is a case in which the flexible cable becomes charged due to sliding against the various components of the printing apparatus in a state of being in contact therewith. When the flexible cable contacts conductive members, such as metal, in a charged state, contact discharging causes noise to be generated and as a result of the noise being superimposed with the signal which is transmitted through the flexible cable, this can become the cause of erroneous operation in the printing apparatus.

SUMMARY

An advantage of some aspects of the invention is to provide a printing apparatus in which an occurrence of erroneous operations is suppressed by preventing the noise from being superimposed in the flexible cable.

According to an aspect of the invention, there is provided a printing apparatus which prints onto a recording medium by causing a print head which performs printing to move in a main scanning direction, and causing the recording medium to move in a sub-scanning direction relative to the print head, includes a flexible cable in which at least a portion of a flat surface thereof faces a recording surface of the recording medium, and through which a signal is transmitted from a control substrate to the print head via a plurality of conductors; a supporting member which is provided so as to support the flat surface of the flexible cable; and a first insulating member which is provided between the supporting member and the flexible cable.

According to the aspect of the printing apparatus, hanging down of the flexible cable due to its own weight is prevented by the support of the supporting member, for example. Even if the flexible cable which is in a charged state makes contact with the support member, the movement of the charge is suppressed by the first insulating member which is provided between the flexible cable and the supporting member. Therefore, since noise which is caused by contact discharging does not easily superimpose with the signal which is transmitted through the flexible cable, it is possible to suppress the occurrence of erroneous operations.

The printing apparatus may further include a top plate which is provided on the print head on an opposite side from the control substrate; and a second insulating member which is provided between the top plate and the flexible cable. In this configuration, even if the curvature of an inverted portion in the flexible cable increases and the flexible cable which is in a charged state makes contact with the top plate, the movement of the charge is suppressed by the second insulating member. Therefore, since noise does not easily superimpose with the signal which is transmitted through the flexible cable, it is possible to suppress the occurrence of erroneous operations.

The printing apparatus may further include a frame which fixes the control substrate; and a third insulating member which is provided between the frame and the flexible cable. In this configuration, even if the flexible cable which is in a charged state makes contact with the frame, the movement of the charge is suppressed by the third insulating member. Therefore, since noise does not easily superimpose with the signal which is transmitted through the flexible cable, it is possible to suppress the occurrence of erroneous operations.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the figures. The printing apparatus according to the embodiment is an ink jet printer which prints an image (including characters and drawings) corresponding to image data which is supplied from a host computer by forming an ink dot group on a recording medium such as paper by discharging a liquid ink. Furthermore, in the present specification, a surface of the recording medium on which ink is adhered and an image is formed is referred to as the recording surface.

Figure 1:
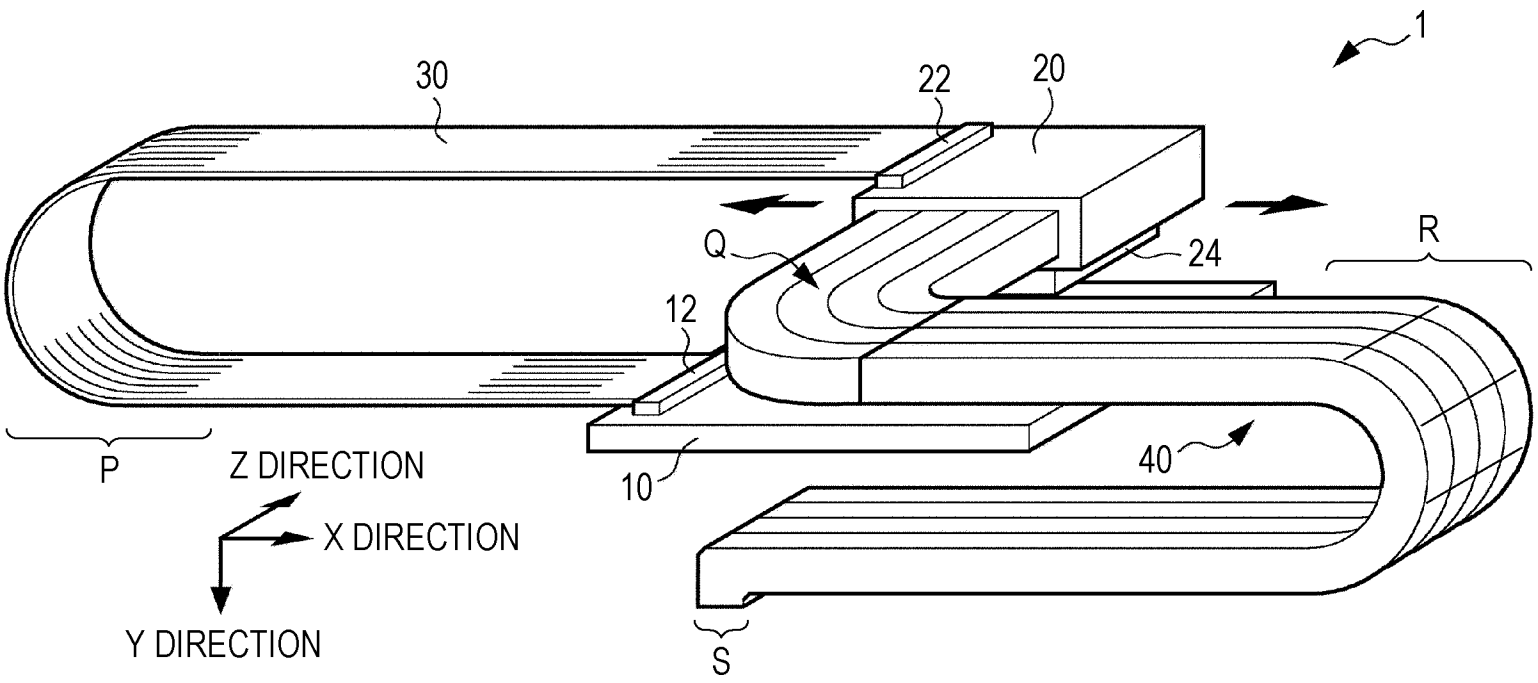
FIG. 1 is a perspective view of the main parts which shows the configuration of the periphery of a print head in a printing apparatus.

FIG. 1 is a perspective view of the main parts which shows the configuration of the periphery of the print head in a printing apparatus 1. In FIG. 1, the control substrate 10 is fixed to the frame (not shown in FIG. 1) of the printing apparatus 1 and generates various types of control signal for printing. The control signals generated by the control substrate 10 are transmitted to the print head 20 via a connecter 12, the flexible cable 30 and a connecter 22, in this order. The print head 20 is installed on a carriage 24 which is movable in an X direction (the main scanning direction) which orthogonally intersects a Z direction, which is the transport direction (the sub-scanning direction) of the recording medium. Furthermore, the print head 20 is integral with the carriage 24 and moves reciprocally along the X direction while maintaining an approximately fixed distance between itself and the surface of the recording medium. The print head 20 includes a plurality of nozzles. Each of the nozzles discharges an amount of ink according to a control signal, which is transmitted through the flexible cable 30, toward the recording medium at a timing which is defined by the control signal. Furthermore, in FIG. 1, to avoid complexity of the configuration, the recording medium is omitted. In addition, in the embodiment, the Y direction is the gravity direction.

The flexible cable 30 is formed in a belt shape in which a plurality of conductors are lined up in parallel so as to form a surface and are covered with an insulative material. As the name implies, the flexible cable 30 has flexibility. Furthermore, in the specification, a surface on which the plurality of conductors are arranged in parallel is referred to as the flat surface. The flexible cable 30 is drawn out in a substantially parallel manner along the main scanning direction from the left side of the print head 20 in FIG. 1, for example. That is, the flexible cable 30 is drawn out such that the extending direction of the conductors matches the main scanning direction, in other words, to intersect the sub-scanning direction when seen from a plan view. Furthermore, the flexible cable 30 is configured so as to be drawn out from the left side from the print head 20, and subsequently, to be inverted to the right side by the arc-shaped loop P and connected to the control substrate 10. Therefore, the flexible cable 30 transmits the control signal from the control substrate 10 to the print head 20 while changing the size and position of the loop P together with the movement of the print head 20.

A configuration is adopted in which an ink tube 40 is connected to each of the plurality of nozzles in the print head 20 and, for example, four colors worth of ink is supplied from an ink tank which is provided on the housing side. Specifically, the flexible cable 30 is drawn out from the print head 20 in the opposite direction from the side at which the recording medium is disposed. In addition, at a bending portion Q, the flexible cable 30 bends to the right side, which opposes the side from which the flexible cable 30 is drawn out, and is drawn out in a substantially parallel manner along the main scanning direction. Furthermore, the flexible cable 30 is configured to be inverted to the left side by an arc-shaped loop R and connected to an ink tank (not shown) at a connecting portion S. A portion of the ink tube 40 from the connecting portion of the print head 20 to the bending portion Q is formed from a stiff member, and the other portions are formed from soft members. Therefore, in the same manner as the flexible cable 30, the ink tube 40 supplies the ink from an ink tank to the print head 20 while changing the size and position of the loop R together with the movement of the print head 20.

Furthermore, since the content of each calculation process for the printing which is executed by the control substrate 10 is a well-known point in the technical field of the printing apparatus, description thereof will be omitted. In addition, the printing apparatus 1 includes a mechanism of a carriage motor or the like for causing a carriage, which is installed in the print head 20, to move in the main scanning direction, and a mechanism of a transport motor or the like for transporting the recording medium in the sub-scanning direction. In addition, the control substrate 10 includes a configuration which supplies drive signals to the motors. However, since the above items are also well-known, description thereof will be omitted.

Figure 2:
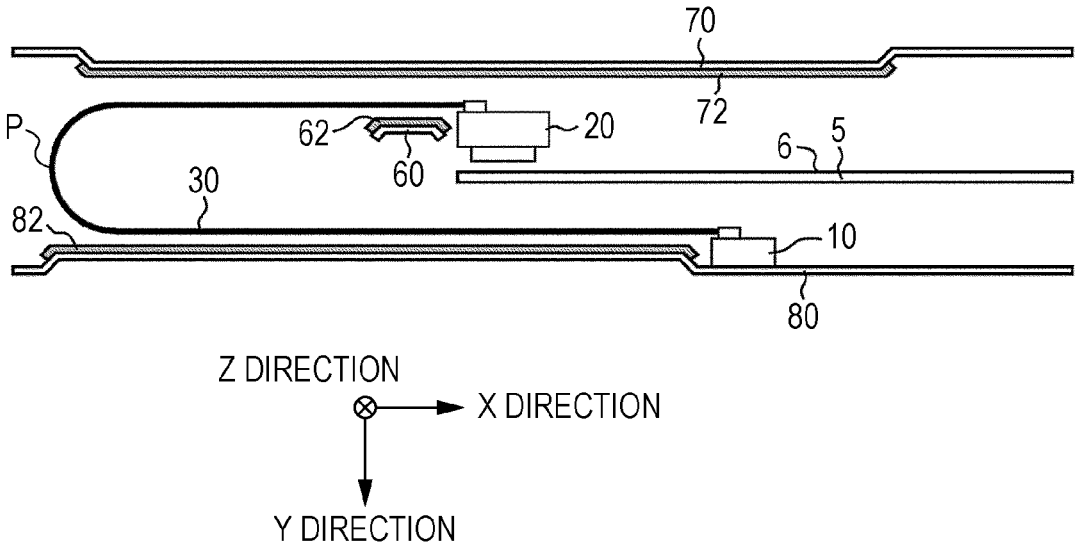
FIG. 2 is a side view of the main parts which shows the configuration of the periphery of the print head in the printing apparatus.

FIG. 2 is a side view of the main parts which shows the configuration of the periphery of the print head 20 in the printing apparatus 1 in a state of observing the configuration by facing the Z direction in FIG. 1. As shown in FIG. 2, the control substrate 10 is fixed, for example, to a frame 80, which is a substantially horizontal surface (the X-Z plane) in the housing. In addition, a recording medium 5 is transported in the Z direction (the depth of the paper surface) so as to be directly below the print head 20 and substantially parallel with the X-Z plane. Meanwhile, the nozzles in the print head 20 discharge the ink in the Y direction, which is the gravity direction. Therefore, in FIG. 2, the upper surface side of the recording medium 5 is a recording surface 6.

Here, an insulating film (a second insulating member) 82 is, for example, bonded with an adhesive or the like to a region which is the upper surface of the frame 80 and opposes the flexible cable 30. Meanwhile, a top plate 70, which has a surface which opposes the frame 80 via the flexible cable 30, is provided on the upper portion of the print head 20. An insulating film (a third insulating member) 72 is bonded to a region which is the lower surface of the top plate 70 and opposes the flexible cable 30. In addition, the plate-shaped supporting member (a first insulating member) 60 for suppressing the slack of the flexible cable 30 is provided on the inside of the loop P, which is the left side of the print head 20, such that the plate surface is horizontal to the housing. An insulating film 62 is bonded to a region which is the upper surface of the supporting member 60 and opposes the flexible cable 30. Furthermore, in the embodiment, the supporting member 60, the top plate 70 and the frame 80 are all configured from a conductive metal plate such as steel. In addition, in FIG. 2, the ink tube 40 is omitted.

FIGS. 4A to 5B are side views of the main parts showing the positional relationships of the flexible cable 30 together with the movement of the print head 20. Furthermore, in the drawings, a comparative example in which the insulating films 62, 72 and 82 are not present is shown in order to describe the effects of the embodiment which includes the insulating films 62, 72 and 82.

Figure 4A:
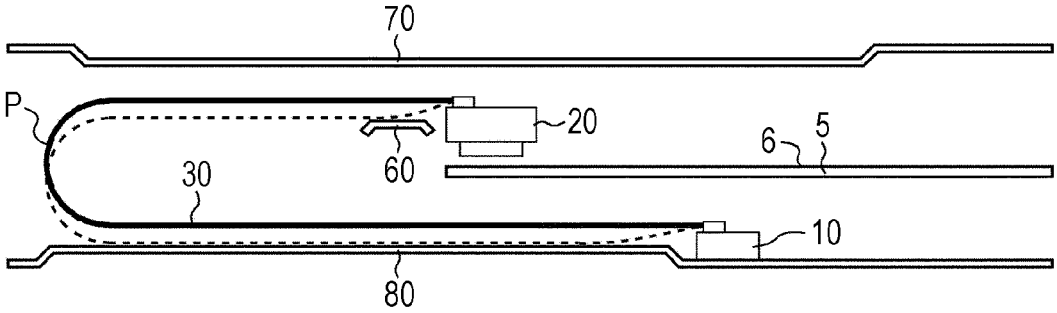
FIGS. 4A and 4B are views which show the positioning, the deforming and the like of the flexible cable.
Figure 4B:
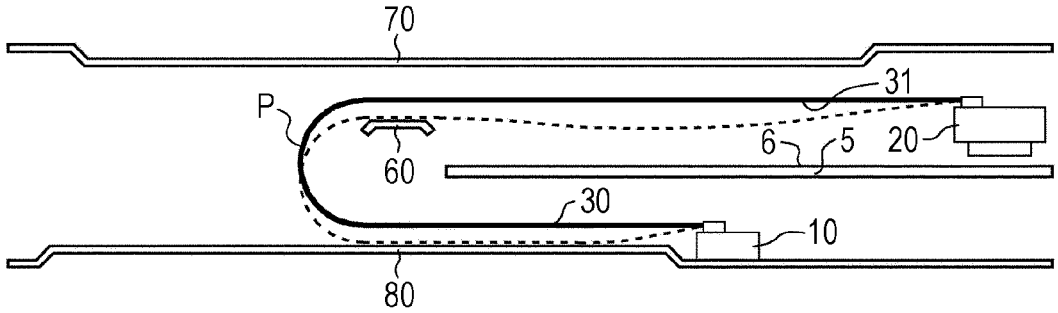
Figure 5A:
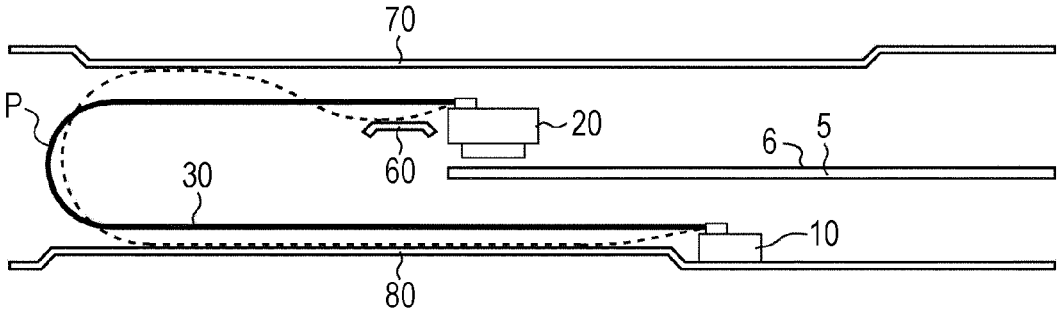
FIGS. 5A and 5B are views which show the positioning, the deforming and the like of the flexible cable.
Figure 5B:
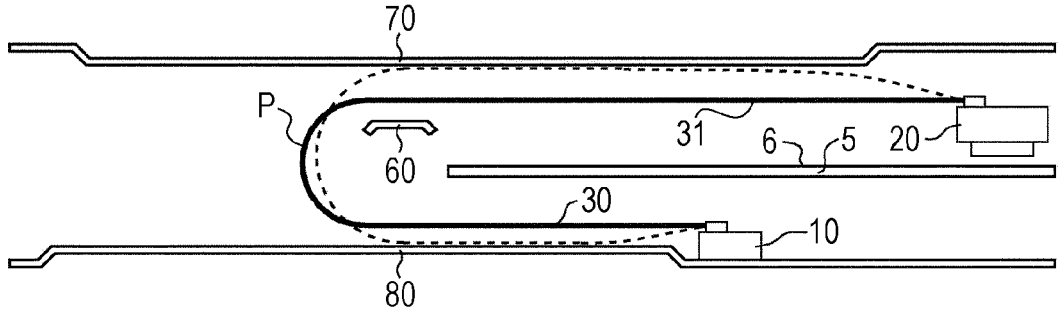

Here, in FIGS. 4A to 5B, in the movement range of the print head 20, FIGS. 4A and 5A show the left end position and FIGS. 4B and 5B show the right end position. Together with the movement of the print head 20, in the flexible cable 30, the position of the loop P moves and the shape of the loop P changes. In addition, together with the movement of the print head 20, a portion of a flat surface 31 in the flexible cable 30 is in a positional relationship in which the portion of the flat surface 31 faces the recording surface 6 of the planar recording medium 5. Here, when the repulsion force when the flexible cable 30 is deformed is small or the flexible cable 30 is relatively heavy, as shown by the broken line in FIGS. 5A and 5B, the flexible cable 30 hangs down to the lower side, which is the gravity direction. Therefore, in a state in which the print head 20 is static, the flexible cable 30 makes contact with the supporting member 60 and the frame 80. Meanwhile, when the repulsion force when the flexible cable 30 is deformed is great or the flexible cable 30 is relatively light, as shown by the broken line in FIGS. 5A and 5B, in a state in which the print head 20 is static, the flexible cable 30 makes contact with, not only the supporting member 60 and the frame 80, but also the top plate 70.

Furthermore, FIGS. 4A to 5B merely show an example of the state of the flexible cable 30. In actuality, the mode of the flexibility of the flexible cable 30 differs according to the material, the thickness, the number of lines, the line length, the weight and the like of the flexible cable 30 and there is also a case in which contact is made with only the supporting member 60 or the frame 80.

Here, when the print head 20 moves, the flexible cable 30 makes contact with or separates from the frame 80 without sliding thereon and slides on the supporting member 60 or the top plate 70. Accordingly, together with the movement of the print head 20, in the flexible cable 30, the insulating material which covers the surface of the conductor easily becomes charged.

Figure 6A:
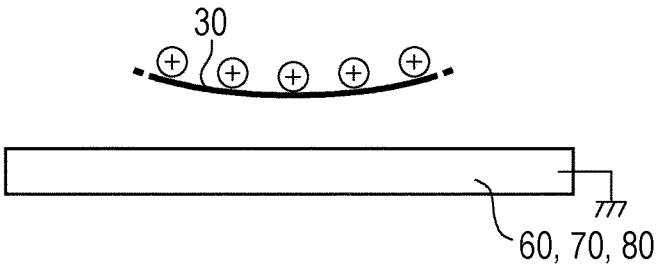
FIGS. 6A to 6C are views which show the principle of noise being generated by the contact between the flexible cable and the other parts in a comparative example.
Figure 6B:
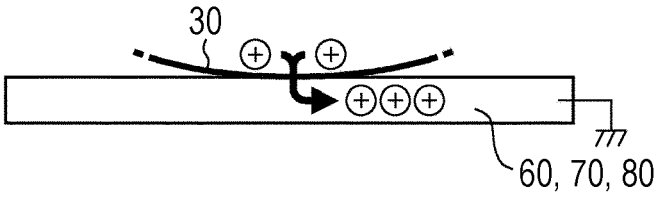
Figure 6C:
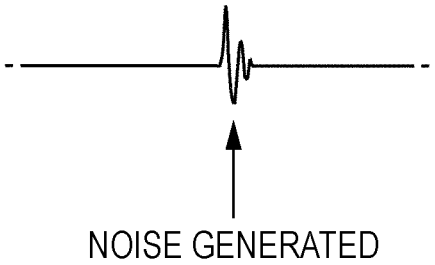

As shown in FIG. 6A, in a state in which the flexible cable 30 is charged, a movement of charge occurs when the flexible cable 30 makes contact with the conductive supporting member 60, the top plate 70 or the frame 80, as shown in FIG. 6B. Therefore, as shown in FIG. 6C, noise is superimposed with the control signal which is transmitted through the flexible cable 30. When noise is superimposed with the control signal in this manner, this causes erroneous operations such as fluctuations in the timing at which ink is discharged from the nozzle and the discharge amount.

Figure 3A:
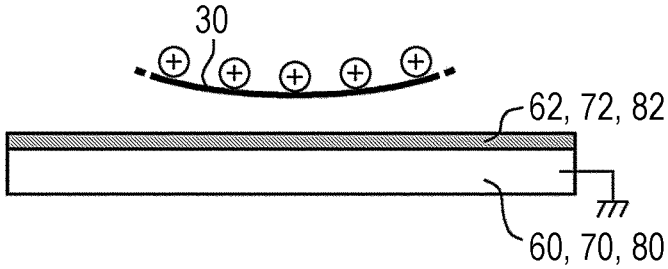
FIGS. 3A to 3C are views which show the contact and the like between the flexible cable and the other parts in the printing apparatus.
Figure 3B:
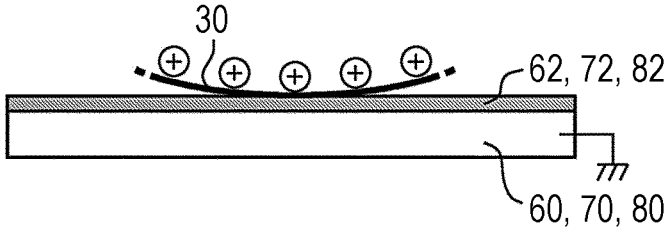
Figure 3C:
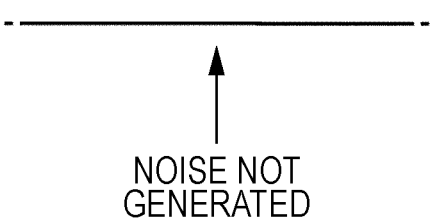

In contrast, in the embodiment, as shown in FIG. 2, in the surfaces of the sides which make contact with the flexible cable 30, the insulating film 62 is bonded to the supporting member 60, the insulating film 72 is bonded to the top plate 70 and the insulating film 82 is bonded to the frame 80. Therefore, in the embodiment, as shown in FIG. 3A, in a state in which the flexible cable 30 is charged, a movement of charge can be suppressed even when the flexible cable 30 makes contact with one of the insulating films 62, 72 or 82 as shown in FIG. 3B. Therefore, as shown in FIG. 3C, it is possible to suppress the superimposition of noise with the control signal which is transmitted through the flexible cable 30. Therefore, according to the embodiment, it is possible to suppress the occurrence of erroneous operations caused by superimposition of noise.

Furthermore, when preventing the flexible cable 30 from becoming charged due to sliding, other countermeasures such as providing an anti-static brush may be considered. However, other problems occur, such as excessive restriction of the movement of the flexible cable 30, wearing and degradation of the brush portion due to the environment (moisture). In contrast, such problems do not occur in the embodiment.

In the embodiment described above, a configuration is adopted in which the insulating film 62 is bonded to the supporting member 60, the insulating film 72 is bonded to the top plate 70 and the insulating film 82 is bonded to the frame 80. However, the supporting member 60, the top plate 70 and the frame 80 may also be configured from an insulating member. The flexible cable 30 is not limited to being one layer, and a plurality of the flexible cables 30 may also be overlapped and used. In addition, the flexible cable 30 may also be used with a resin member overlapped therewith in order to protect the flexible cable 30.

Furthermore, the insulating member in the specification may have a degree of insulation properties so as not to cause a problem with the signal which is transmitted through the flexible cable, specifically, may have insulation properties in which the volume specific resistivity is $3\times10^{15}$ (Ω·m, 20° C., measurement method JIS C2151) or higher. For example, a polyester film or the like can be used.

The entire disclosure of Japanese Patent Application No. 2013-002363, filed Jan. 10, 2013 is expressly incorporated by reference herein.

What is claimed is:

1. A printing apparatus which prints onto a recording medium by causing a print head which performs printing to move in a main scanning direction, and causing the recording medium to move in a sub-scanning direction relative to the print head, comprising:

a flexible cable in which at least a portion of a flat surface thereof faces a recording surface of the recording medium, and through which a signal is transmitted from a control substrate to the print head via a plurality of conductors;

a supporting member which is provided so as to support the flat surface of the flexible cable;

a first insulating member which is provided between the supporting member and the flexible cable; and a motor which moves the hint head;

wherein a distance between the print head and the supporting member is changed when the print head is moved by the motor.

2. The printing apparatus according to claim 1, further comprising:

a top plate which is provided on the print head on an opposite side from the control substrate; and a second insulating member which is provided between the top plate and the flexible cable.

3. The printing apparatus according to claim 1, further comprising:

a frame which fixes the control substrate; and a second insulating member which is provided between the frame and the flexible cable.

4. A printing apparatus which prints onto a recording medium by causing a print head which performs printing to move in a main scanning direction, and causing the recording medium to move in a sub-scanning direction relative to the print head, comprising:

a flexible cable in which at least a portion of a flat surface thereof faces a recording surface of the recording medium, and through which a signal is transmitted from a control substrate to the print head via a plurality of conductors;

a supporting member which is insulative and is provided so as to support the flat surface of the flexible cable; and a motor which moves the print head;

wherein a distance between the print head and the supporting member is changed when the print head is moved by the motor.

* * * * *